United States Patent [19]

Capp et al.

[11] Patent Number: 5,030,138

[45] Date of Patent: Jul. 9, 1991

[54] MLG CONNECTOR FOR WELD TERMINATION

[75] Inventors: Randolph E. Capp, Mechanicsburg; Keith S. Koegel, Linglestown; Tracy L. Smith, Harrisburg, all of Pa.

[73] Assignee: AMP Incorporated, Harrisburg, Pa.

[21] Appl. No.: 592,012

[22] Filed: Oct. 2, 1990

[51] Int. Cl.[5] ..... H01R 4/24

[52] U.S. Cl. ..... 439/497

[58] Field of Search ..... 439/92, 497, 885

[56] References Cited

U.S. PATENT DOCUMENTS

| | | | |
|---|---|---|---|
| 3,482,201 | 12/1969 | Sschnecket al. | 439/497 |
| 3,691,509 | 9/1972 | Kroll | 439/497 |
| 4,083,615 | 4/1978 | Volinskie | 339/17 F |
| 4,310,208 | 1/1982 | Webster et al. | 339/14 R |
| 4,379,361 | 4/1983 | Webster et al. | 29/857 |
| 4,437,723 | 3/1984 | Narozny | 339/99 R |
| 4,442,594 | 4/1984 | Narozny | 29/884 |
| 4,464,003 | 8/1984 | Goodman et al. | 339/99 R |
| 4,484,792 | 11/1984 | Tengler et al. | 339/143 R |
| 4,579,404 | 4/1986 | Lockard | 339/14 R |
| 4,586,769 | 5/1986 | Tengler et al. | 339/59 R |
| 4,602,830 | 7/1986 | Lockard | 339/14 R |
| 4,602,831 | 7/1986 | Lockard | 339/14 R |
| 4,649,636 | 3/1987 | Arbogast, Jr. et al. | 29/861 |
| 4,655,515 | 4/1987 | Hamsher et al. | 339/14 R |
| 4,682,840 | 7/1987 | Lockard | 439/874 |
| 4,875,877 | 10/1989 | Fleak et al. | 439/497 |
| 4,880,388 | 11/1989 | Beamenderfer et al. | 439/108 |
| 4,975,069 | 12/1990 | Fedder et al. | 439/497 |

*Primary Examiner*—Joseph H. McGlynn
*Attorney, Agent, or Firm*—Gerald K. Kita

[57] ABSTRACT

A connector assembly 6 comprises, conductive contacts 9 for connection to wires 2, 5 of at least one electrical cable 1, an insulative housing block 16, the contacts 9 being on superimposed lead frames 12A, 12B, and the lead frames 12A, 12B are bent for positioning the contacts 9 parallel with one another in a row.

11 Claims, 8 Drawing Sheets

10
11
38
9
12B
9B
12A
9A 10
38
25
21
22
20
12B
12A
16
17
18
9

10
16
17
18
9

12
12A
7
16

MLG CONNECTOR FOR WELD TERMINATION

FIELD OF THE INVENTION

The invention relates to a connector assembly for connection to conductive wires to form a cable assembly.

BACKGROUND OF THE INVENTION

A connector assembly disclosed in U.S. Pat. No. 4,875,877 comprises, a conductive ground bus, for connection to ground wires of at least one electrical cable, and conductive signal contacts for connection to signal wires of at least one electrical cable, the signal contacts being joined to the ground bus, an insulative housing block applied over the contacts, at least a selected one of the contacts being detached from the ground bus, and at least one of the signal contacts remaining joined to the ground bus. The connector assembly is constructed for ease of manufacture. For example, the contacts and the ground bus are joined together in a lead frame to eliminate separate parts. The housing block advantageously holds the contacts in desired positions when the contacts are connected to the wires. The contacts are held on pitch spacings that correspond to the pitch spacings of contact receiving cavities of an insulative housing. The contacts are assembled into the cavities of the housing as a group, rather than as individual contacts.

The contacts on the lead frame, being fabricated of thin metal, are easily deflected to misaligned positions. A concern exits that the contacts will be held by a housing block in these misaligned positions. For example, a housing can be applied over the contacts by injection molding fluent plastic material over portions of the contacts. The solidified plastic material is relied on to hold the contacts in their positions. If the contacts are misaligned while the housing is applied, the contacts will be held by the housing in misaligned positions.

A concern exists that, when the contacts are ready for assembly into contact receiving cavities of the housing, the contacts will be out of alignment with the contact receiving cavities. Some degree of misalignment of the contacts and the cavities would be present, due to dimensional tolerance differences in such contacts and in such cavities. More pronounced misalignment could be present because of difficulties experienced in applying the housing block to the contacts, as described in the previous paragraph of text. The misaligned contacts can be damaged by forced insertion within the cavities. In addition, the contacts can be misaligned while in the cavities. Thus, there is a need to prevent damage to contacts during insertion in the cavities, and to reduce the manufacturing time expended to assure careful insertion of the contacts. Further, an need exists to prevent rotation, a form of misalignment, of the contacts in the cavities.

SUMMARY OF THE INVENTION

The invention results from a need to guide the contacts during insertion into corresponding cavities of dan insulative housing. The contacts are formed with tapered fins. The fins are used for guiding the contacts into precisely oriented positions within cavities of an insulative housing. The fins enter slits in the housing. The slits urge the fins in guided progressive movement within the housing. In turn, the fins urge the contacts to positions that are precisely aligned within corresponding cavities of the housing. The cooperation between the fins and the slits will move misaligned contacts into desired positions, and thereafter will hold and retain the contacts in those positions. Assembly of the contacts into the housing is accomplished without forcible insertion of the contacts, thereby averting damage to the contacts.

For an understanding of the invention, reference will now be made by way of example to a following detailed description and accompanying drawings.

DETAILED DESCRIPTION

Figure 10:
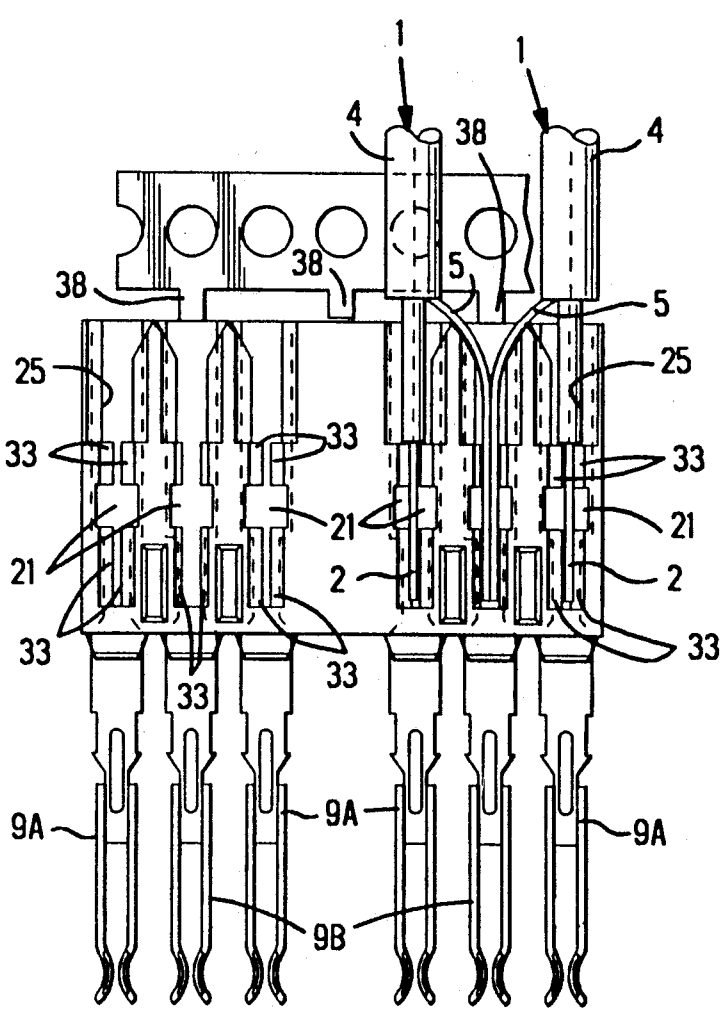
FIG. 10 is a plan view of the structure shown in FIG. 9 with each of three of the contacts connected to a corresponding electrical cable.

With reference to FIG. 10, at least one electrical cable 1 is constructed with an elongated signal wire 2 or center conductor concentrically encircled by a dielectric 3, in turn encircled by a flexible insulative outer jacket 4 or sheath. A corresponding, elongated and conductive ground wire 5 or drain wire extends along the exterior of the dielectric 3 and is within the jacket 4. The cable may include a single ground wire 5, as shown, or may include first and second ground wires 5 to provide a combination of a signal wire 2 between two ground wires 5. The invention applies to either cable construction, or to any other cable construction, not shown. The cable construction is cut to expose and to project the signal wire 2, the dielectric 3 and the corresponding ground wire 5 from the jacket 4.

Figure 1:
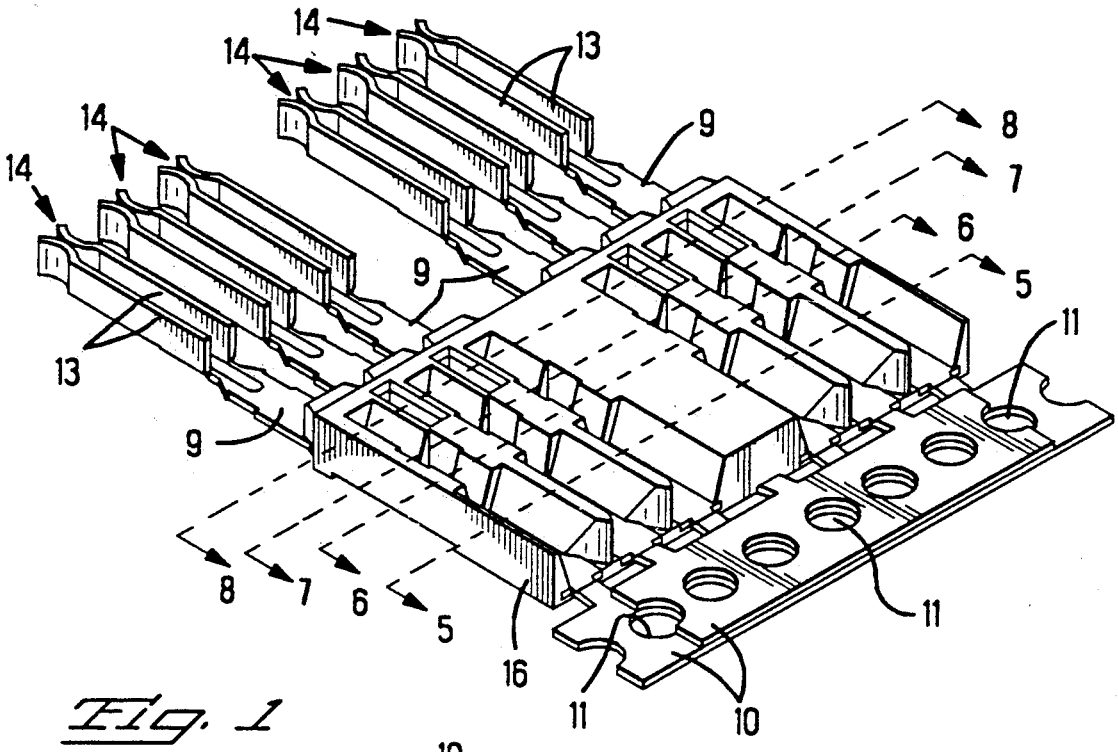
FIG. 1 is a fragmentary perspective view of an insulative housing block and two lead frames of a connector assembly.
Figure 5:
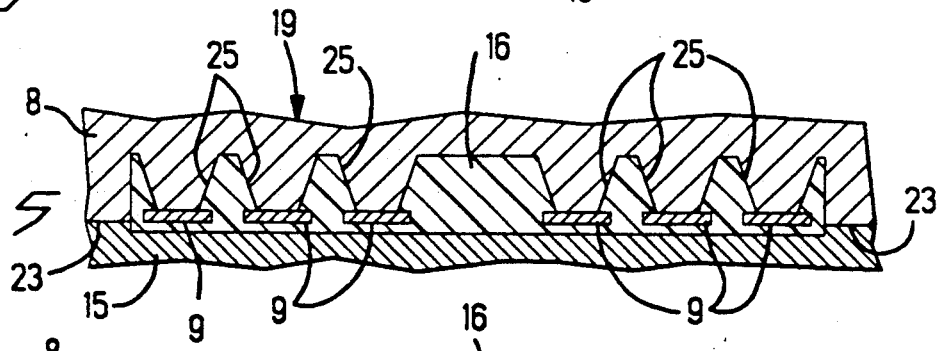
FIG. 5 is a section view taken along the line 5—5 of FIG. 1.
Figure 6:
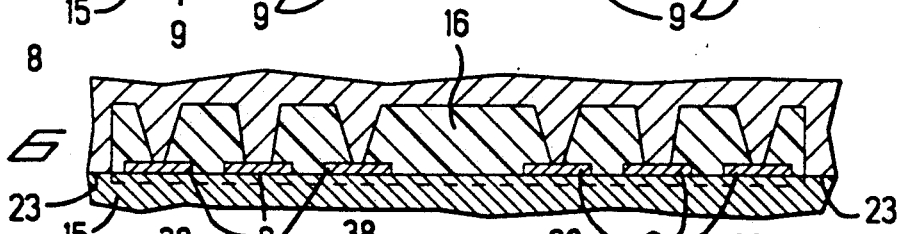
FIG. 6 is a section view taken along the line 6—6 of FIG. 1.
Figure 7:
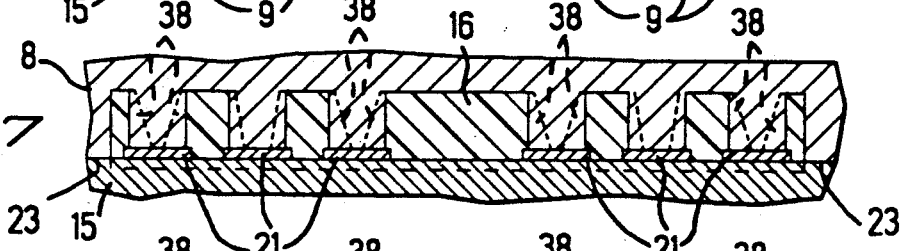
FIG. 7 is a section view taken along the line 7—7 of FIG. 1.
Figure 8:
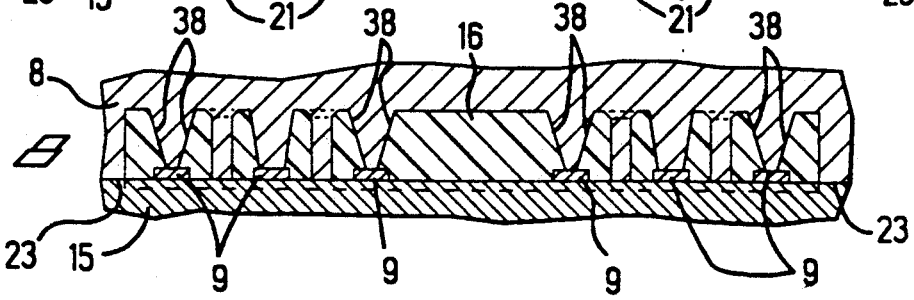
FIG. 8 is a section view taken along the line 8—8 of FIG. 1.
Figures 2, 3, 3A, 4:
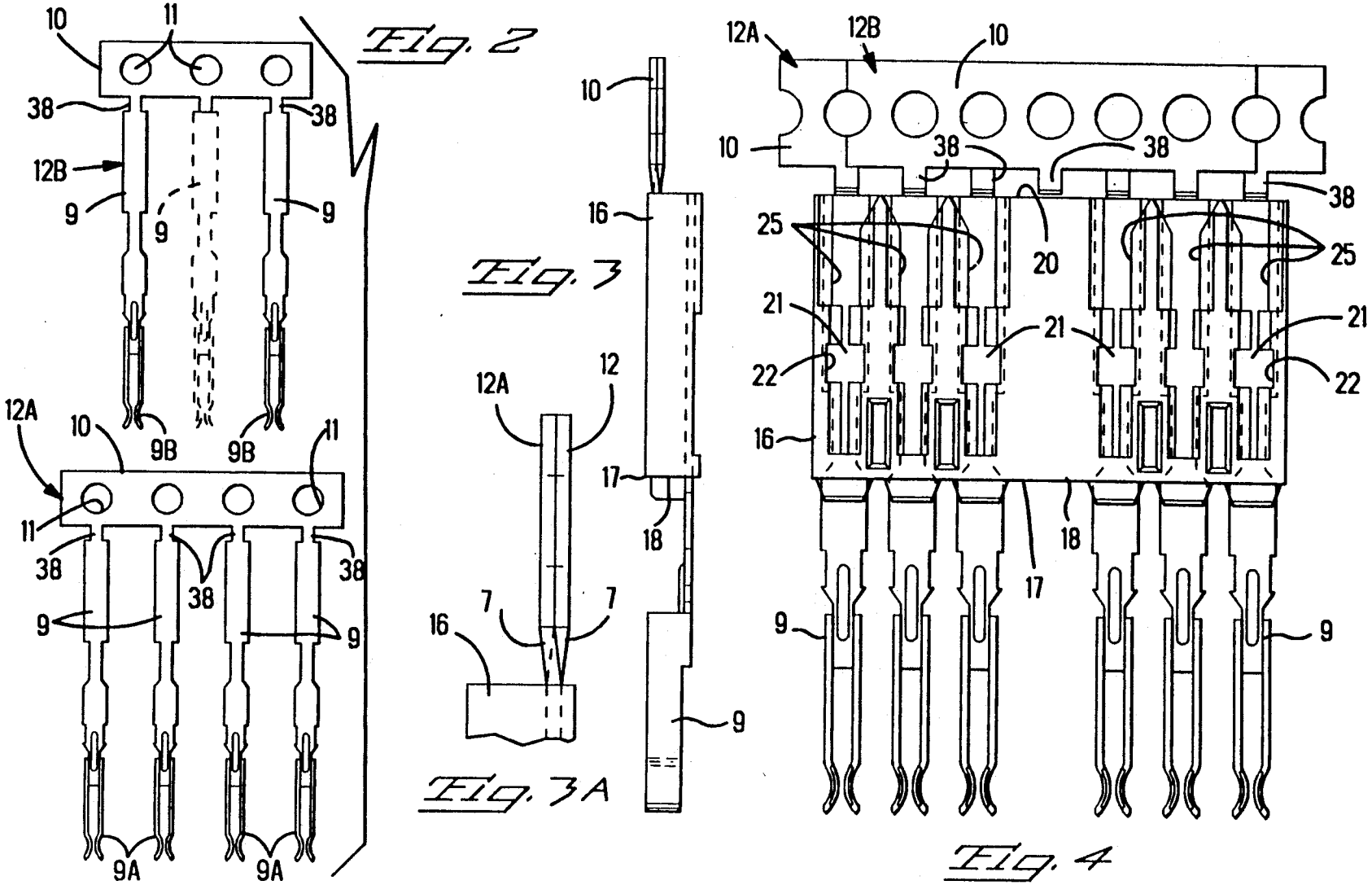
FIG. 2 is a plan view of the two lead frames shown in FIG. 1.
FIG. 3 is a side view of the structure shown in FIG. 1.
FIG. 3A is an enlarged view of a portion of the structure shown in FIG. 3.
FIG. 4 is a fragmentary plan view of the structure shown in FIG. 1.
Figure 13:
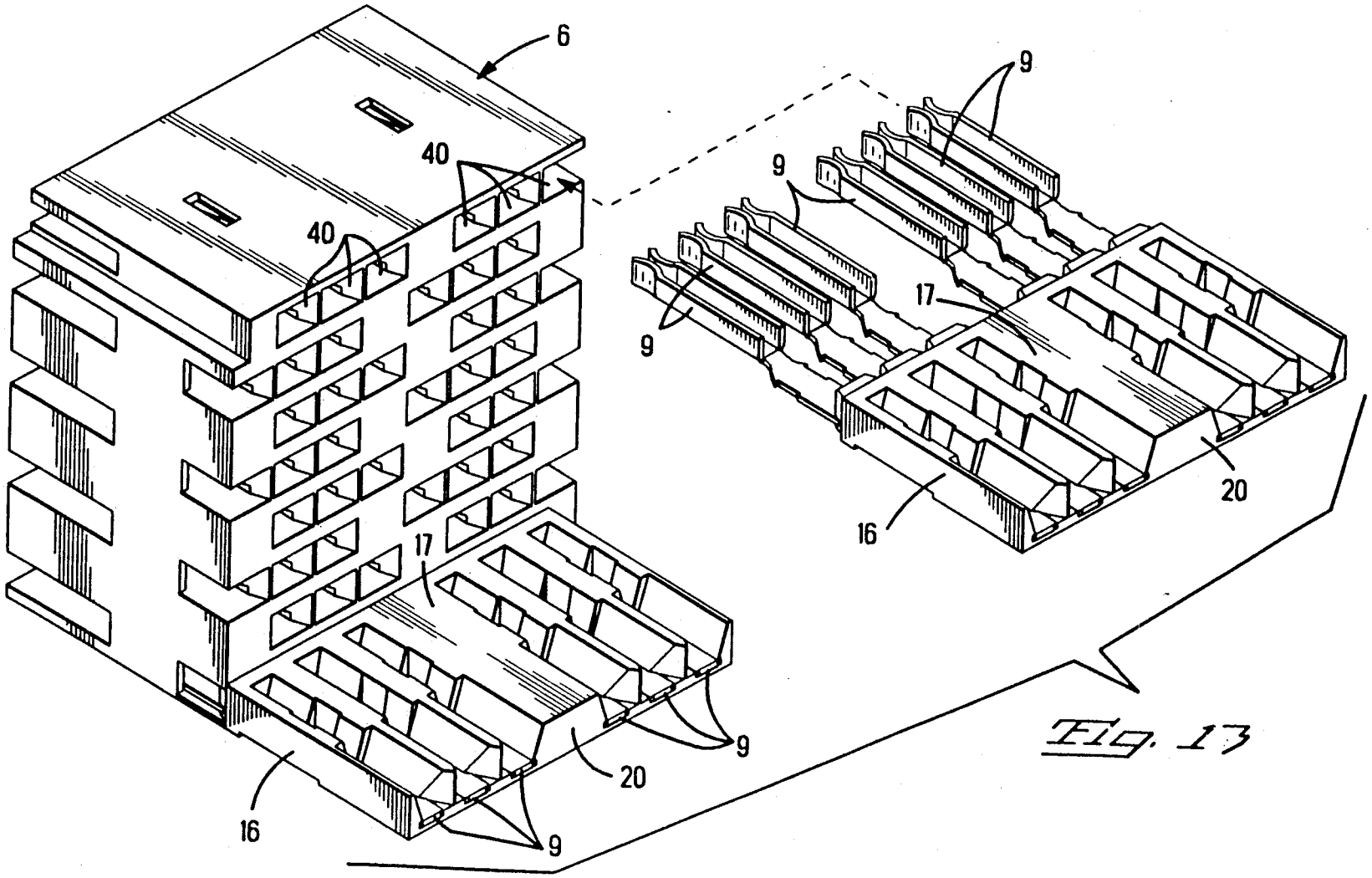
FIG. 13 is a perspective view of an insulative housing receiving corresponding electrical contacts of a type as shown in FIG. 1.
Figure 14:
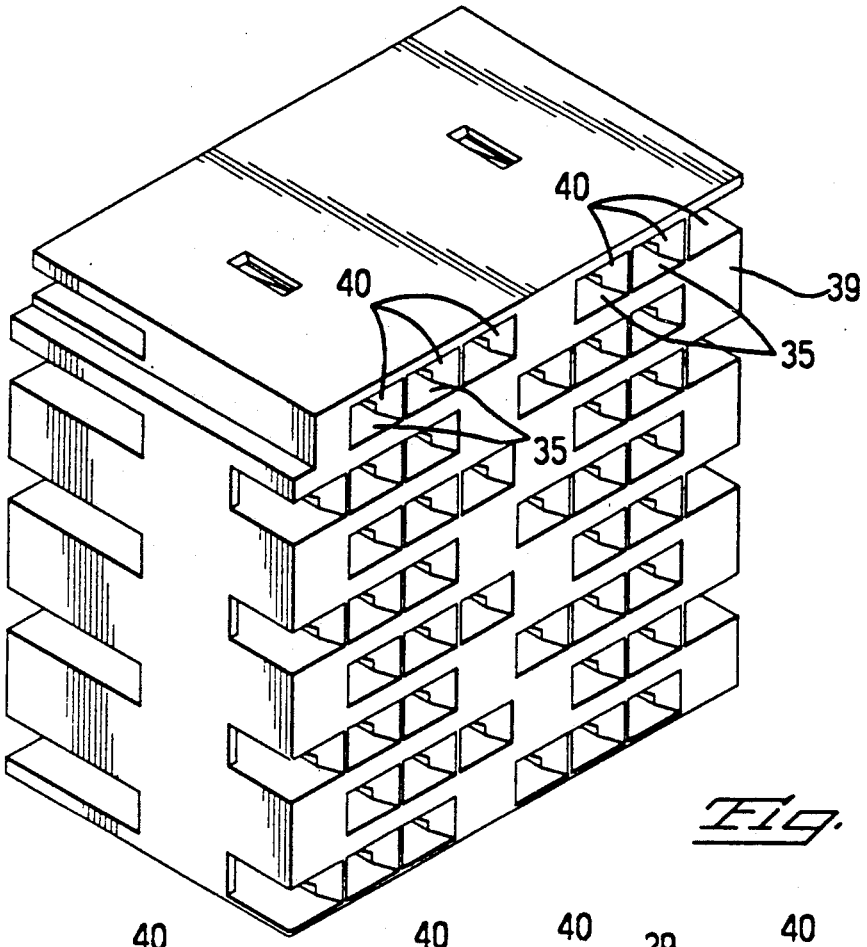
FIG. 14 is a perspective view of an insulative housing of a connector assembly with contact receiving cavities.
Figure 15:
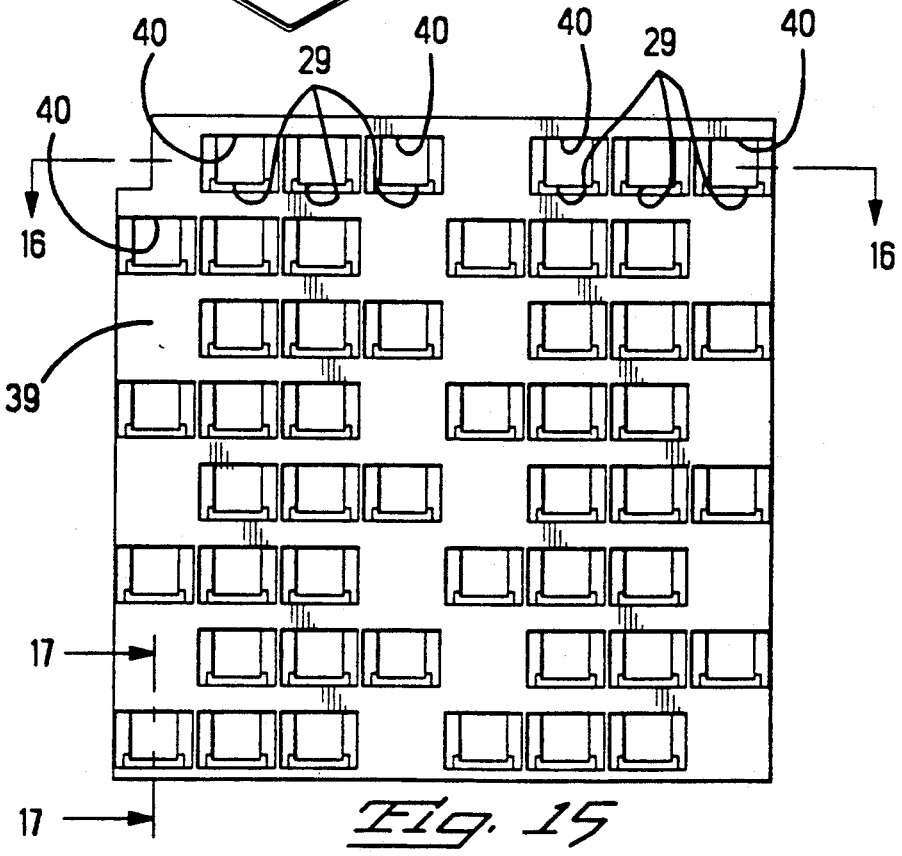
FIG. 15 is a front elevation view of the housing shown in FIG. 13.
Figure 16:
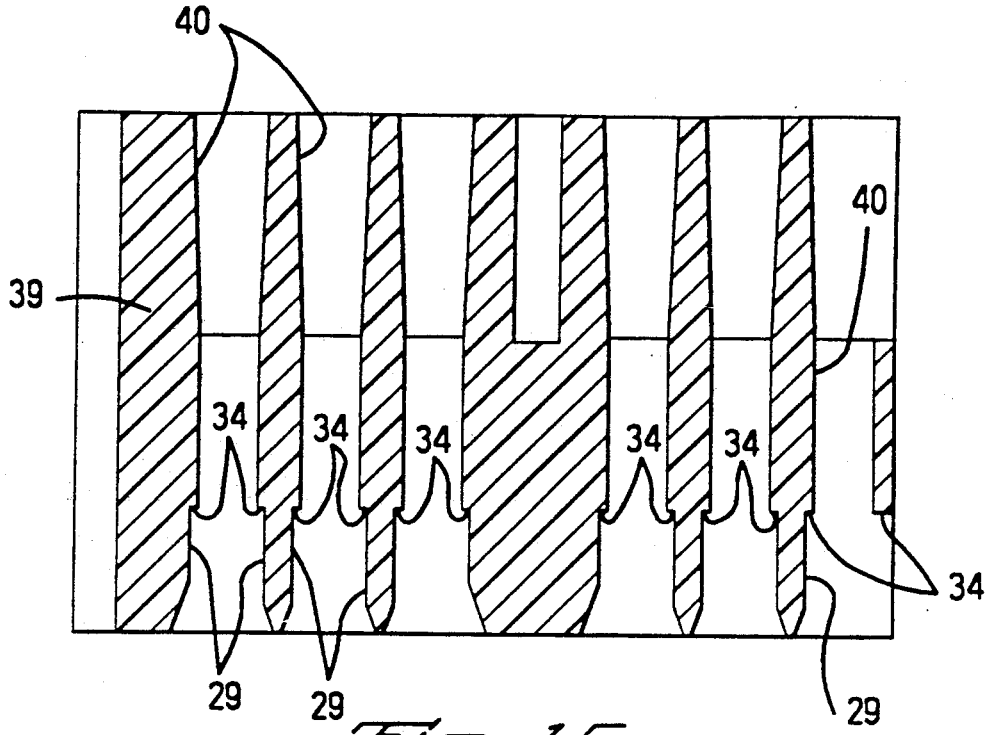
FIG. 16 is a fragmentary section view taken along the line 16–16 of FIG. 15.
Figure 17:
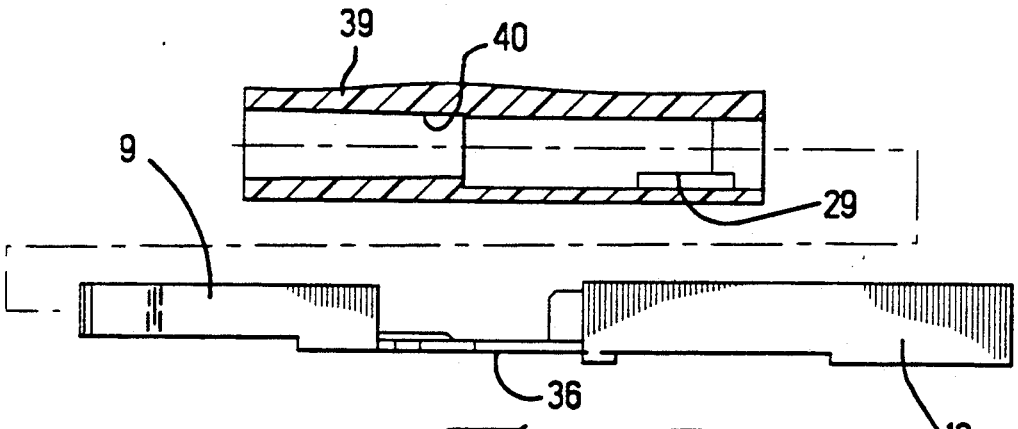
FIGS. 17 and 18 are fragmentary section views of the housing taken along the line 17—17 of FIG. 15, and further illustrating a corresponding contact as shown in FIG. 9.
Figure 18:
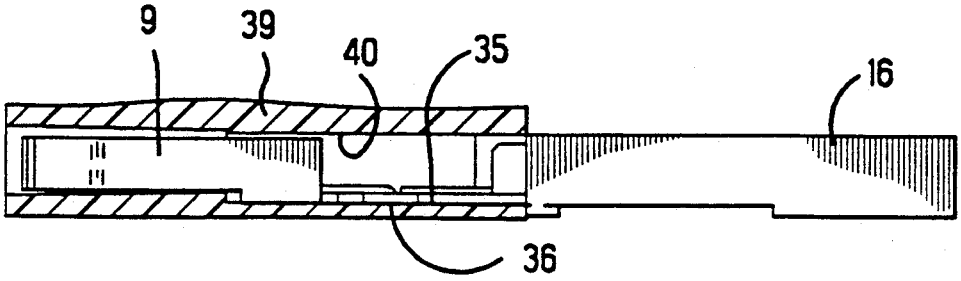

With reference to FIG. 13, an electrical connector assembly 6 is to be connected to one or multiple cables 1 in a manner described below. Construction of the connector assembly 6 begins with a row of electrical contacts 9. With reference to FIGS. 1 and 2, the contacts 9 project forwardly from a corresponding, elongated ground bus 10. A series of pilot holes 11 extend through the ground bus 10. The contacts 9 when joined to the ground bus 10 provide a lead frame, correspondingly numbered 12 or 12A, shown in FIG. 2, known as an array of conductive paths for conducting electricity, with the paths joined together and cut out from a strip of metal. Each of the contacts 9 includes a pair of spaced apart fingers 13 defining an electrical receptacle 14 at a front end. The fingers 13 are cut out from the strip of metal while the metal is in a flat plane. The fingers 13 of each of the contacts 9 are formed by bending, such that the fingers 13 are pivoted out of the plane of the metal to oppose each other and to define therebetween the receptacle 14. The contacts 9 are on pitch spacings, that are the repeated spacings between longitudinal axes of the multiple contacts 9 in a row. The fingers 13 are cut out of portions of the metal strip that bridge between adjacent contacts 9.

Figure 12:
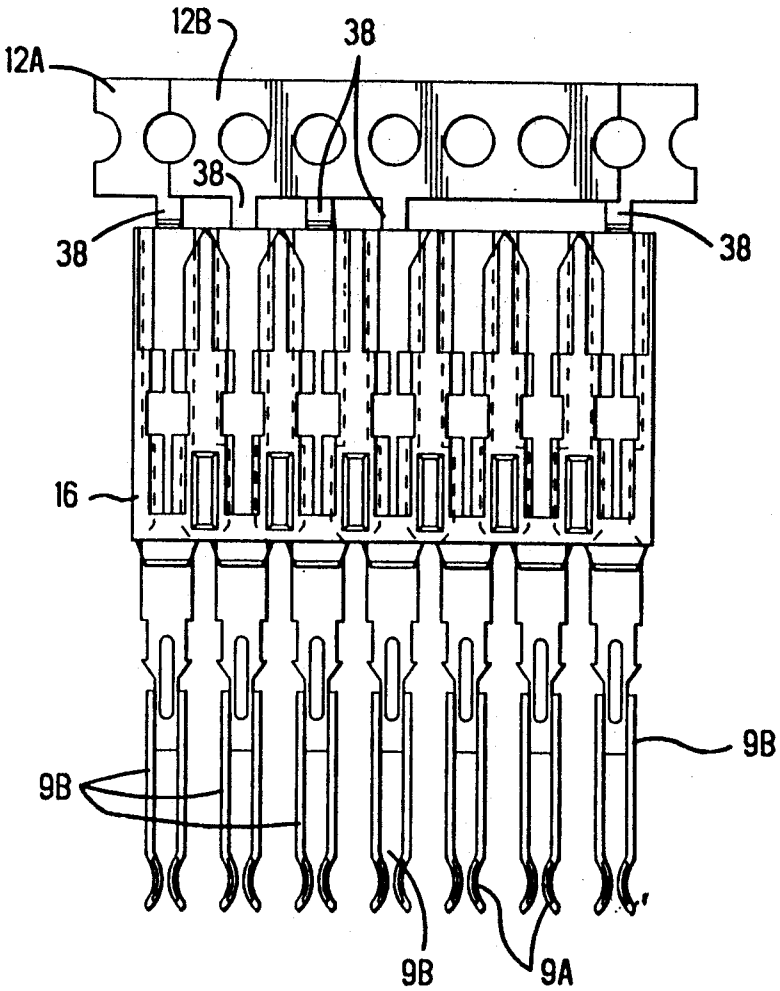
FIG. 12 is a plan view of an insulative housing block of a connector assembly, with ground contacts connected to a corresponding ground bus and signal contacts separated from a corresponding ground bus.

As shown in FIG. 2, two lead frames 12, 12A with attached contacts 9 can be stacked and superimposed, laid one on the other, to provide a series of contacts 9 in a row. The pitch spacing of the series of contacts 9 in the row is desirably decreased to attain a compact size, when two lead frames 12A, 12B are superimposed. With reference to FIG. 2, a construction is depicted wherein one of the contacts 9 is depicted in phantom outline to indicate that the contact 9 can be removed from the corresponding lead frame 12A and eliminated from the series of contacts 9. The contacts 9 of the lead frame 12A alternate with the contacts 9 of the second lead frame 12B in an alternating series of said contacts 9. FIG. 12 shows a series of contacts 9 wherein no contact 9 is eliminated from the series of contacts 9.

With reference FIGS. 1, 3, 3A and 4, an insulative housing block 16 is applied to each contact 9 that remains joined to a corresponding frame 12A, 12B. For example, the housing block 16 is formed by injection molding fluent plastics material that embeds the contacts 9. A front end 17 of the housing block is formed with a front wall 18 extending transverse to the row of contacts. The housing block 16 extends to a rear wall 20 from which each ground bus 10 projects. Wire connecting portions 21 of the contacts 9 appear at corresponding spaced apart, openings 22 formed by molding the housing block 16. The housing block 16 holds all the contacts 9 on a desired pitch spacing. The contacts 9 are on the first and second lead frames 12A, 12B, and comprise a series of contacts 9 in a row wherein the contacts 9 of the first lead frame 12A, 12B, and the contacts 9 of the second lead frame 12A, 12B, are in the row.

Wire receiving channels 25, formed by molding the housing block 16, extend from the rear wall 20 and forwardly and axially of corresponding contacts 9. With reference to FIG. 10, the signal wire 2 of the cable 1 and each corresponding ground wire 5 of the cable 1 extend along corresponding channels 25. The signal wire 2 extends along the channel 25 to the wire connecting portion 21 of a corresponding contact 9. Each corresponding ground wire 5 extends along a corresponding channel 25 to the wire connecting portion 21 of a corresponding contact 9.

Further details of construction of the housing block 16 are described in U.S. Pat. No. 4,875,877, according to which, wire gripping portions 33 of the housing block 16 are provided for gripping and positioning the wires 2 and 5 that extend across corresponding wire connecting portions 21, and further according to which, the connection between a corresponding wire 2 and 5 and a corresponding wire connecting portion 21 is accomplished by a welding operation or a soldering operation. As shown in FIG. 10, each contact 9 that is connected to a signal wire 2 is designated a signal contact 9A. Each contact 9 that is connected to a ground wire is designated a ground contact 9B. Each contact 9 is joined to a corresponding lead frame 12A, 12B by a removable portion 38 in the form of a narrow portion of the lead frame 12A, 12B.

With reference to FIG. 2, an advantage of the invention resides in all the signal contacts 9A being removably joined to one lead frame 12A by the corresponding removable portions 38. The advantage becomes more evident with reference to FIGS. 9 and 10, which depict the signal contacts 9A as being separated from the remainder of the lead frame 12A, and from one another, for example, by severing and removing the removable portions 38 and the ground bus 10 from the signal contact 9. The remainder of the lead frame 12A is discarded when no longer needed.

With reference to FIGS. 3 and 3A, another advantage of the invention is that the lead frames 12, 12A are bent, as shown at 7, to bring the contacts 9 of both lead frames 12, 12A into a common plane. A common plane for the contacts 9 contributes to the object of achieving precise location of the contacts 9, especially important for locating the contacts precisely, and especially important to prevent damage to the contacts 9 when they are connected to corresponding wires 2 and 5 and when they are inserted into an insulative housing 39. With reference to FIGS. 3 and 3A, precise alignment of the contacts 9 is achieved further in the following manner. The removable portion 38 are attached and extend between the contacts 9 and the corresponding ground busses 10. The removable portions 38 are bent along their lengths to bring their forward ends into a common plane. Thereby, the bent removable portions 38 orient the contacts 9 of both lead frames 12, 12A in coplanar relationship.

With reference to FIGS. 5, 6, 7 and 8, the coplanar contacts 9 are held in precise alignment when the insulative material of the housing block 16 is applied. For example, the insulative material is applied by an injection molding process, with molding dies 8, 15 of a conventional, injection molding apparatus 19 holding the contacts 9 along a parting line 23 of the dies 8, 15 while the insulative material is injected into die cavities 24, 26 to form the housing block 16. The metal thickness of the contacts 9 is clamped between the dies 8, 15 and is held stationary. The metal thickness, where clamped, blocks the flow of fluent insulative material. In this manner, the insulative material is blocked from covering over the wire connecting portions 21 of the contacts 9 and those portions of the contacts 9 that project from the front end 14 and from the rear wall 20 of the housing block 16. The solidified housing block 16 holds the contacts 9 in desired positions, including desired pitch spacings, after ejection from the dies 8, 15.

Figure 9:
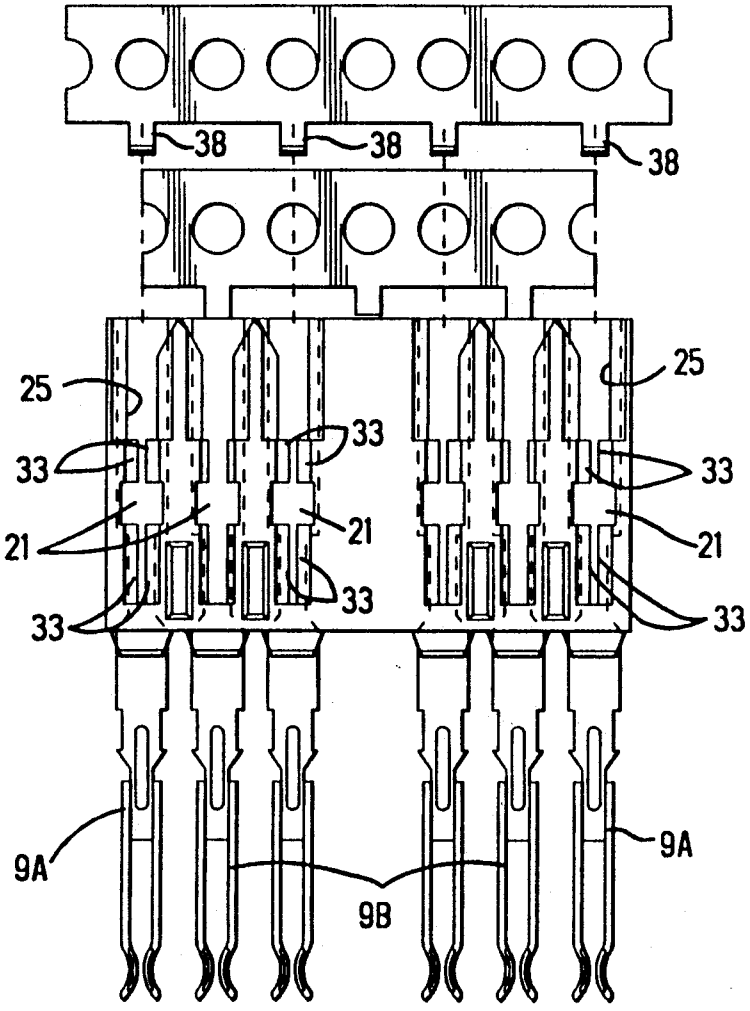
FIG. 9 is a plan view of an insulative housing block of a connector assembly, with ground contacts connected to a ground bus, and a ground bus shown removed from signal contacts.

The row of contacts 9 in FIGS. 9 and 10 are arranged in a series of contacts 9 wherein each of the contacts 9 of the first lead frame 12 alternates in the series with a contact 9 of the second lead frame 12. Upon removal of the first lead frame 12, the corresponding contacts 9 will be separate from one another and are designated signal contacts 9A. The contacts 9 of the second lead frame 12B are designated ground contacts 9 connected to the ground bus 10 of the second lead frame 12B. The series of contacts 9 is arranged in a desired pattern of a signal alternating with a ground or reference. The pattern can be repeated along the series. The pattern is useful in a construction wherein the pitch spacings are close together, and each signal contact 9A is required to be adjacent to at least one ground contact 9B connected to a reference potential. Thereby each ground contact 9B tends to shield a corresponding signal contact 9A from electrical influences that would induce and undesired voltage in the signal contact 9A. A construction is shown in FIG. 10 wherein two ground wires 5 of two different cables 1 are connected to the same ground contact 9. Other constructions are permitted, for example, with one ground wire 5 connected to one ground contact 9.

Figure 11:
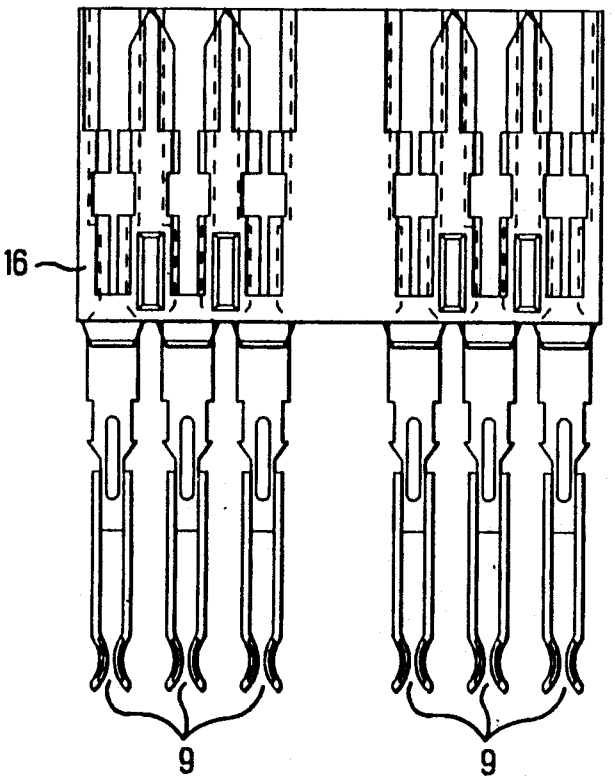
FIG. 11 is a plan view of an insulative housing block of a connector assembly, with ground contacts and signal contacts and without a ground bus.

With reference to FIG. 11, another construction is disclosed wherein the second lead frame 12B is disconnected from the ground contacts 9B to separate the ground contacts 9B from one another and to eliminate the corresponding ground bus 10. This construction allows each ground contact 9B to be connected to a corresponding ground wire 5 without a buss connection to other ground contacts 9B.

With reference to FIG. 12, another construction is disclosed wherein the first ground bus 10 and the second ground bus 10 are connected, for example, by a welding operation or a soldering operation. At least one contact 9 of the first lead frame 12A remains joined to the ground bus 10 of the first lead frame 12A and thereby becomes a ground contact 9B. Any contact 9 that is separated from the lead frames 12A or 12B, for example, by removal of a corresponding removable portion 38, becomes a signal contact 9A that is separated from both lead frames 12A, 12B and from the other contacts 9. Thereby, FIG. 12 discloses a construction wherein selected contacts 9A are removed from a respective lead frame 12A, 12B, and both lead frames 12A, 12B provide a conductive ground bus 10 connected to respective contacts 9B remaining joined to the lead frames 12A, 12B.

Figure 19:
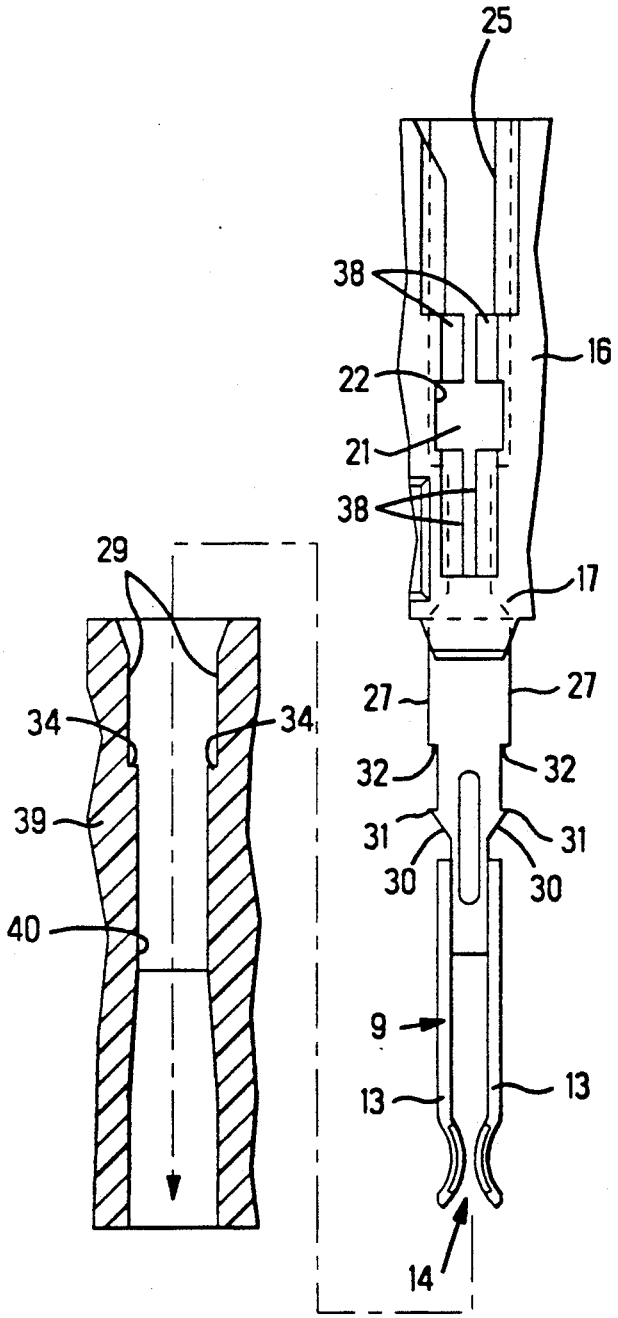
FIGS. 19 and 20 are fragmentary section views of the housing shown in FIG. 15, and further illustrating a corresponding contact as shown in FIG. 9.
Figure 20:
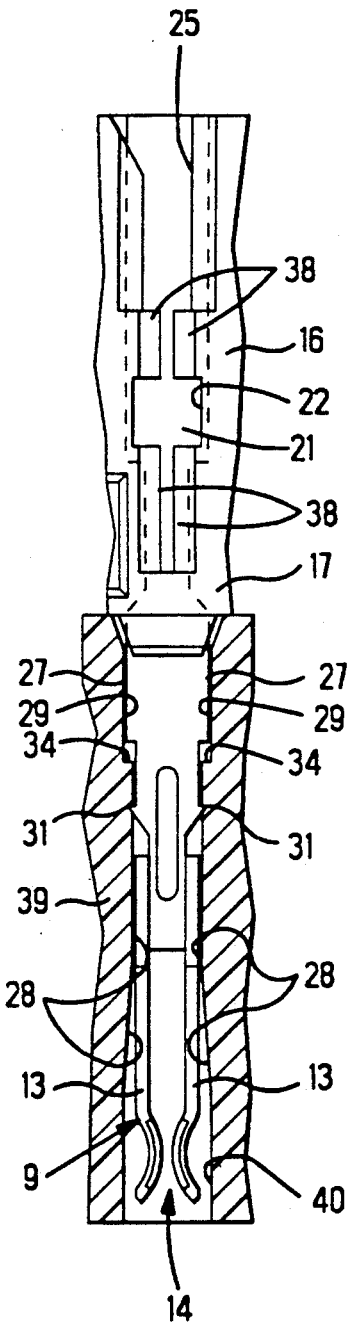

As shown in FIGS. 19 and 20, the contacts 9 have corresponding fins 27 which project in the plane of the metal thickness laterally of the longitudinal axes of the contacts 9. The fins 27 of the contacts 9 of both the first lead frame 12 and the second lead frame 12B are urged into a common plane prior to applying the insulative housing block 16, and prior to retaining the fins 27 in the common plane by the housing block 16.

A feature of the invention will now be described with reference to FIGS. 13, 14, 15, 16, 17, 18, 19 and 20. The contacts 9 project forward of the housing block 16 for assembly with an insulative housing 39. The housing 39 includes multiple contact receiving cavities 40 spaced apart on pitch spacings corresponding to that of the series of contacts 9. A group of contacts 9 is shown fully assembled in corresponding cavities 40 in a representative row, FIG. 13, with the front end 17 of the housing block 10 engaging a rear 41 of the housing 39. For illustration purposes, the cables 1 that are connected to the contacts 9 are omitted from FIG. 13.

With reference to FIGS. 17, 18, 19 and 20, insertion of the contacts 9 into corresponding cavities 40 will now be described. Generous dimensional clearances, shown at 28, exist between the cavities 40 and the fingers 13 of the contacts 9 to permit insertion of the fingers 13 into the cavities 40 without undue frictional resistance. Further, the clearances 28 permit movement of the fingers 13 in response to insertion of conductive terminal posts, not shown, into the receptacles 14. The clearance 28 would permit undesired movement of the contacts 9 in the cavities 40. As further described below, the fins 27 hold the contacts 9 in the cavities 40 against undesired movement.

The fins 27 are inserted along corresponding slits 29 in the housing 39 to guide the contacts 9 into alignment along corresponding cavities 40. The front edges 30 of the fins 27 are tapered to reduce frictional resistance to insertion of the tapered surfaces 30 along corresponding slits 29. Each of the fins 27 includes a laterally projecting barb 31 that extends diagonally rearward and penetrates the housing 39, FIG. 20, to resist withdrawal of the contacts 9 in a rearward direction. The barbs 31 are dimensioned laterally with an interference fit with the sides of the corresponding slits 29. The barbs 31 are rearward of the fingers 13, which allows the contacts 9 to be inserted along the cavities 40 before the barbs 31 engage the sides of the slits 29. Each fin 27 is stepped laterally wider to provide a forward facing shoulder 32 that faces a rear facing shoulder 34 at a stepped wider portion of each slit 29. To resist movement of the contact 9 in a forward direction, the front end 17 of the housing block 16 engages the housing 39. The fins 27 in the slits 29 hold flat sides 36, FIGS. 17 and 18, of the corresponding contacts 9 against flat side walls 35 of the cavities 40, and resist rotation of the contacts 9 in corresponding cavities 40. Thus, the contacts 9 are held in precise locations within corresponding cavities 40.

We claim:

1. A connector assembly for connection to conductive wires to form a cable assembly comprising: conductive signal contacts for connection to wires of at least one electrical cable, an insulative housing block applied to the contacts and holding the contacts during connection to wires of at least one electrical cable, the housing block holding all the contacts on a desired pitch spacing, the contacts being on first and second lead frames, and the contacts comprise a series of contacts in a row wherein the contacts of the first lead frame and the contacts of the second lead frame are in the row, the lead frames are bent for positioning the contacts parallel with one another, and the housing block holds the contacts parallel with one another.

2. A connector assembly as recited in claim 1, wherein selected contacts are removed from respective lead frames, and each of the lead frames provides a conductive ground bus connected to respective contacts remaining joined to the lead frames.

3. A connector assembly as recited in claim 1, wherein one of the contacts of the first lead frame is absent from the first lead frame.

4. A connector assembly as recited in claim 1, and further comprising: a ground bus on the second lead frame connected to all of the contacts of the second lead frame, and the contacts of the first lead frame being removably joined to a disposable remainder of the first lead frame.

5. A connector assembly as recited in claim 4, wherein each of the contacts of the second lead frame is between two contacts of the first lead frame.

6. A connector assembly as recited in claim 4, wherein each of the contacts of the first lead frame alternate with the contacts of the second lead frame in an alternating series of said contacts.

7. A method for assembly of an electrical connector assembly comprising the steps of: forming a conductive first lead frame with unitary electrical contacts having fins, forming a conductive second lead frame with unitary electrical contacts having fins, laying the second lead frame over the first lead frame, whereby a series of electrical contacts are formed by each of the contacts of the first lead frame being positioned adjacent to at least one of the contacts of the second lead frame, applying an insulative housing block over the series of contacts, using the housing block to hold the contacts on pitch spacings, and inserting the fins along corresponding slits in an insulative housing to guide the contacts into alignment along corresponding contact receiving cavities of the housing.

8. A method as recited in claim 7, and further comprising the steps of: bending both the first lead frame and the second lead frame to urge the contacts of both lead frames in a series of contacts in a row until solidification of material comprising the housing block holds the contacts in the row.

9. A method as recited in claim 7, and further comprising the steps of: urging the fins of both the first lead frame and the second lead frame into a common plane prior to the step of applying the insulative housing block, and retaining the fins in the common plane by the housing block.

10. A method as recited in claim 7, and further comprising the step of: urging the fins of both the first lead frame and the second lead frame into a common plane until solidification of material comprising the housing block holds said fins in the common plane.

11. A method as recited in claim 7, and comprising the steps of: providing a conductive ground bus on each of the lead frames, separating at least a selected one of said electrical contacts from a ground bus of the first lead frame, and connecting the ground bus of the first lead frame with the ground bus of the second lead frame.

* * * * *